US012247763B2

(12) United States Patent
Francis

(10) Patent No.: US 12,247,763 B2
(45) Date of Patent: Mar. 11, 2025

(54) PORTABLE ELECTRIC HEATER

(71) Applicant: Mitchell J. Francis, Beverly Hills, CA (US)

(72) Inventor: Mitchell J. Francis, Beverly Hills, CA (US)

( * ) Notice: Subject to any disclaimer, the term of this patent is extended or adjusted under 35 U.S.C. 154(b) by 0 days.

(21) Appl. No.: 18/594,557

(22) Filed: Mar. 4, 2024

(65) Prior Publication Data

US 2024/0377103 A1 Nov. 14, 2024

Related U.S. Application Data

(60) Provisional application No. 63/501,975, filed on May 12, 2023.

(51) Int. Cl.
*F24H 9/00* (2022.01)
*F24H 9/20* (2022.01)

(52) U.S. Cl.
CPC ..... *F24H 9/0073* (2013.01); *F24H 9/2071* (2013.01); *F24H 2240/01* (2013.01)

(58) Field of Classification Search
None
See application file for complete search history.

(56) References Cited

U.S. PATENT DOCUMENTS 1,644,595 A * 10/1927 Karg ..... F24H 3/0411 126/90 A
2,443,695 A * 6/1948 Russell ..... A47L 23/205 34/104
2,481,077 A * 9/1949 Buell ..... F24H 3/002 392/374
2,560,349 A * 7/1951 Inglis ..... A47C 21/048 219/217
2,683,796 A * 7/1954 Koff ..... F24H 3/0411 126/110 B
2,835,049 A * 5/1958 Jacobs ..... D06F 58/16 392/382
3,229,070 A * 1/1966 Wells ..... F24H 3/0417 415/206
3,444,922 A * 5/1969 Dingman ..... A61H 35/00 219/217
3,575,582 A * 4/1971 Covault ..... H05B 3/009 165/122
3,584,632 A * 6/1971 Weidner ..... A45D 4/16 132/229
3,626,602 A * 12/1971 Glowacki ..... D06F 58/14 34/232
3,858,331 A * 1/1975 Lord ..... D06F 58/10 34/239
4,053,732 A * 10/1977 Carter ..... F24H 3/081 165/104.34

(Continued)

*Primary Examiner* — Thor S Campbell
(74) *Attorney, Agent, or Firm* — Welsh Flaxman & Gitler LLC

(57) ABSTRACT

A portable electric heater comprises a heater unit, base assembly, and a shaft extending upwardly from the base assembly. The shaft includes a first end secured to the base assembly and a second end to which the heater unit is secured. The portable electric heater also comprises a renewable energy source and a power assembly including a power management module for controlling power distribution of the renewable energy source to the heater unit.

12 Claims, 9 Drawing Sheets

(56) References Cited

U.S. PATENT DOCUMENTS 4,136,464 A * 1/1979 Hay ..... A47L 23/20 34/104
4,593,179 A * 6/1986 Schulz ..... F24H 3/0405 137/341
4,595,008 A * 6/1986 Guibert ..... B64D 11/0007 607/107
4,947,025 A * 8/1990 Alston ..... F24H 1/08 392/471
5,103,577 A * 4/1992 Michaels ..... A47K 10/48 34/91
5,199,188 A * 4/1993 Franz ..... A47L 23/205 34/104
5,287,636 A * 2/1994 Lafleur ..... F26B 21/006 34/239
5,394,619 A * 3/1995 Kaplan ..... F26B 25/18 34/104
5,467,423 A * 11/1995 Jakubowski ..... H05B 3/845 392/382
5,478,379 A * 12/1995 Bevins ..... B01D 46/10 96/138
5,511,145 A * 4/1996 Bailey ..... F24H 3/002 392/355
5,578,230 A * 11/1996 Eldon ..... A47G 9/0215 392/383
5,592,749 A * 1/1997 Trimmer ..... A45D 20/14 219/541
5,805,767 A * 9/1998 Jouas ..... F24H 9/2071 392/360
D417,751 S * 12/1999 Simento ..... D28/73
6,205,679 B1 * 3/2001 Rodway ..... F26B 21/001 34/90
6,698,106 B1 * 3/2004 Reithel ..... F26B 21/008 34/104
6,842,581 B2 * 1/2005 Schafer ..... A47K 10/48 392/382
7,088,913 B1 * 8/2006 Verhoorn ..... F24H 3/0411 392/360
7,190,887 B1 * 3/2007 Compton ..... F24H 3/0417 219/533
7,631,377 B1 * 12/2009 Sanford ..... A47G 9/0215 5/413 R
8,408,869 B2 * 4/2013 Hutton ..... F04D 25/08 415/121.2
8,526,799 B2 * 9/2013 Peet ..... F24H 3/002 392/350
8,613,601 B2 * 12/2013 Helps ..... F04D 29/444 417/198
8,721,286 B2 * 5/2014 Gammack ..... F04D 29/681 416/246
9,395,100 B2 * 7/2016 Crowe ..... F24H 3/0417
9,408,452 B1 * 8/2016 Al-Khulaifi ..... A46B 15/0002
9,782,016 B2 * 10/2017 Aramli ..... A47C 21/048
10,582,776 B2 * 3/2020 Aramli ..... A47C 21/048
10,588,419 B2 * 3/2020 Aramli ..... F24F 11/62
10,945,569 B1 * 3/2021 Varghese ..... F24H 3/0411
10,961,655 B2 * 3/2021 Hinkey ..... D06F 59/02
11,365,934 B2 * 6/2022 Jheng ..... A47K 10/48
11,457,714 B2 * 10/2022 Rocha ..... A45D 20/14
11,478,086 B2 * 10/2022 Kennedy ..... F16L 11/118
11,559,175 B2 * 1/2023 Wright ..... A47B 67/005
11,700,951 B2 * 7/2023 Aramli ..... F24H 3/0411 5/423
11,754,090 B2 * 9/2023 Jung ..... F04F 5/16 415/208.1
11,874,027 B1 * 1/2024 Miller ..... F24H 3/0417
11,944,204 B2 * 4/2024 Aramli ..... F24H 3/0411
2003/0026600 A1 * 2/2003 Delonghi ..... F04D 25/10 392/367
2004/0197091 A1 * 10/2004 Orr ..... F24H 3/0417 392/360
2004/0218912 A1 * 11/2004 Shapiro ..... F04D 17/04 392/365
2006/0085911 A1 * 4/2006 Tompkins ..... A47C 21/048 5/423
2006/0182429 A1 * 8/2006 Shapiro ..... F24H 3/0411 392/365
2008/0240689 A1 * 10/2008 Coke ..... F24H 3/0417 392/367
2015/0184937 A1 * 7/2015 Hywel ..... F26B 9/066 34/232
2016/0099595 A1 * 4/2016 Chien ..... H02J 7/00 362/253
2016/0099596 A1 * 4/2016 Chien ..... H02J 7/00 362/253
2018/0266044 A1 * 9/2018 Durham ..... D06F 59/04
2022/0400911 A1 * 12/2022 Ceesay ..... A61L 2/24

* cited by examiner

PORTABLE ELECTRIC HEATER

CROSS-REFERENCE TO RELATED APPLICATIONS

This application claims the benefit of U.S. Provisional Patent Application Ser. No. 63/501,975, entitled "PORTABLE ELECTRIC HEATER," which was filed on May 12, 2023, and which is incorporated herein by reference.

BACKGROUND OF THE INVENTION

1. Field of the Invention

The present invention relates to a portable electric heater.

2. Description of the Related Art

Outdoor patio heaters have been sold for both residential and business use, and their use has substantially increased recently as people look for ways in which to spend time outdoors. Outdoor patio heaters are very useful, but they are difficult and oftentimes dangerous to use.

SUMMARY OF THE INVENTION

In an aspect a portable electric heater comprises a heater unit, base assembly, and a shaft extending upwardly from the base assembly. The shaft includes a first end secured to the base assembly and a second end to which the heater unit is secured. The portable electric heater also comprises a renewable energy source and a power assembly including a power management module for controlling distribution of electrical power from the renewable energy source to the heater unit.

In some embodiments the renewable energy source is at least one rechargeable battery.

In some embodiments the at least one rechargeable battery is a rechargeable lithium-ion battery.

In some embodiments the base assembly includes a base platform with a plurality of side walls extending upwardly therefrom.

In some embodiments the plurality of side walls includes a first side wall, a second side wall, and a third side wall, respectively extending upwardly from edges of the base platform. A fourth side wall is connected, via a hinge, to the third side wall allowing for access to a cavity.

In some embodiments at least one rechargeable battery is positioned within the cavity of the base assembly.

In some embodiments the power management module includes a circuit board assembly.

In some embodiments the power management module also includes an on/off & heat control actuator, a charging inlet port, a USB outlet port, and an information/control panel.

In some embodiments the power assembly also includes an inverter.

In some embodiments the heater unit includes a horizontally oriented heater assembly telescopically supported by the shaft.

In some embodiments the heater assembly includes an elongated heater housing, a heating element, and an air blower assembly for providing an adjustable heated air stream at a height above the base assembly.

In some embodiments the heater housing has one or more air inlet openings and an air outlet opening.

In some embodiments a protective grills is disposed over the one or more air inlet openings and the air outlet opening.

In some embodiments the air blower assembly includes at least one motor and an air impeller.

In some embodiments the heater assembly also includes an oscillation mechanism that moves the heater housing through rotation and/or oscillation movement.

Other objects and advantages of the present invention will become apparent from the following detailed description when viewed in conjunction with the accompanying drawings, which set forth certain embodiments of the invention.

DETAILED DESCRIPTION OF THE INVENTION

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1:
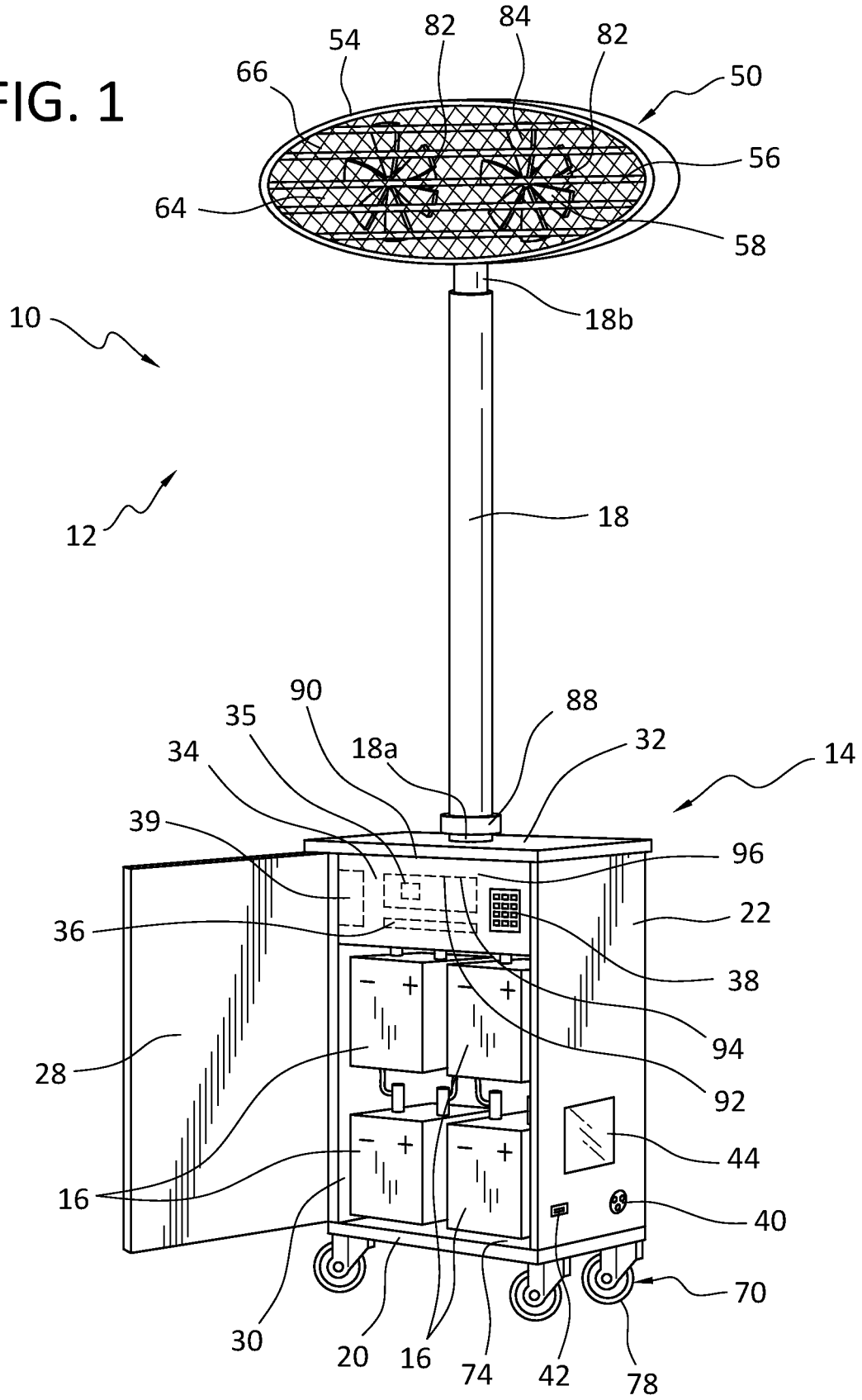
FIG. 1 is a front view of the portable electric heater.
Figure 2:
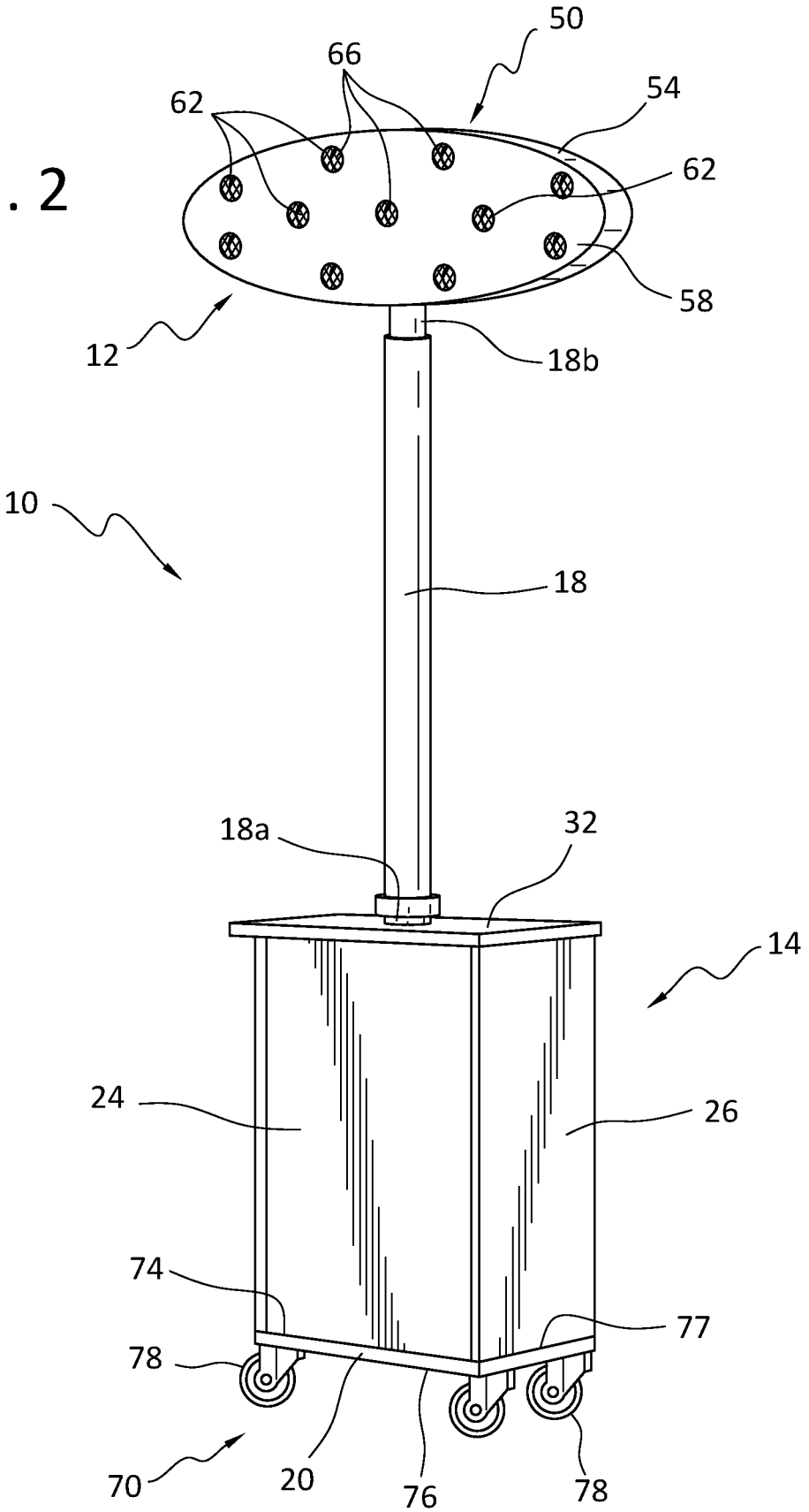
FIG. 2 is a rear view of the portable electric heater.

Referring to FIGS. 1 and 2, a portable electric heater 10 is disclosed. The portable electric heater 10 includes a heater unit 12 and base assembly 14. As will be appreciated based upon the following disclosure, a renewable energy source 16 is stored within the base assembly 14 for powering the heater unit 12. In accordance with a disclosed embodiment, the renewable energy source 16 is a rechargeable battery (ies), in particular, a rechargeable lithium-ion battery. While lithium-ion batteries are disclosed in accordance with a disclosed embodiment, the renewable energy source of the present invention may take various forms. For example, the energy source may take the form of solid-state batteries, forms of rechargeable batteries other than lithium-ion batteries, and/or hydrogen fuel cells. While the batteries of the disclosed embodiments are constructed for charging while in the base assembly, it is appreciated the batteries could be constructed such that they are readily removable, rechargeable, and replaceable.

The portable electric heater 10 also includes a support shaft 18 that extends upwardly from the base assembly 14. The support shaft 18 includes a first end 18*a* secured to the base assembly 14 and a second end 18*b* to which the heater unit 12 is secured. In accordance with a disclosed embodiment, the support shaft 18 is telescopic and allows operators to adjust the height of the heater unit.

The base assembly 14 includes a base platform 20 with a plurality of side walls 22, 24, 26, 28 extending upwardly therefrom. In accordance with a preferred embodiment, the base platform 20 is square-shaped and a first side wall 22, a second side wall 24, and a third side wall 26, respectively, extend upwardly from edges of the square (or rectangular) shaped base platform 20. A fourth side wall 28 is connected, via a hinge, to the third side wall 26 allowing for access to a cavity 30 defined by the base assembly 14. It is appreciated that although the present invention is disclosed herein with a square shape, the base assembly 14 may take various shapes depending upon the specifics of the portable electric heater 10. The base assembly 14 itself is primarily constructed from aluminum, although it is appreciated the base assembly 14 may be constructed from various metals or other materials depending upon cost, weight, and manufacturing considerations. For example, it is appreciated the base assembly, and other components of the portable electric heater may be constructed from plastics where the choice of plastic reduces cost and/or weight without sacrificing the structural characteristics and safety associated with the portable electric heater.

Each of the first, second, and third side walls 22, 24, 26 includes a lower end secured to an edge of the square shaped base platform 20. The first, second, and third side walls 22, 24, 26 are attached to each other along their respective adjacent upwardly extending edges. Finally, each of the first, second, and third side walls 22, 24, 26 includes an upper edge, wherein the upper edges of the first, second, and third side walls 22, 24, 26 define an open upper end of the base assembly 14 that is provided with a top member 32. The base platform 20, first side wall 22, second side wall 24, third side wall 26, fourth side wall 28, and the top member 32 define an enclosure 33 of the base assembly 14.

The base assembly 14, in particular, the enclosure 33, defines a cavity 30 within which at least one rechargeable battery 16 (four are shown in a disclosed embodiment). In order to provide the functionality offered by the present portable electric heater 10, each of the rechargeable batteries 16 is a 9-volt, 100-amp hour battery, although larger, and other battery configurations, may be used to provide additional power for larger heating and fan elements. While a specific battery is disclosed above in accordance with a disclosed embodiment, it is appreciated the specifics of the battery could vary depending upon specifics of the location and the use; for example, it is appreciated that a 12 volt, 200 amp hour battery will provide a couple of hours of heat at 1500 watts. Similarly, other battery configurations may offer improvements in cost and efficiency, and could certainly be utilized without departing from the spirit of the present invention. Additional embodiments are disclosed herein and it is appreciated that the preceding discussion regarding the renewable energy source, e.g., battery (ies), is applicable to each of these embodiments.

The base assembly 14 also includes an electrical power assembly 34. The power assembly 34 is secured within the cavity 30 of the enclosure 33 of the portable electric heater 10. The power assembly 34 includes a power management module 35 for controlling various elements of the electrical power, in particular, for controlling distribution of electrical power from the renewable energy source to the heater unit as will be described below in greater detail. The power management module 35 includes a circuit board assembly 36. Wiring extending from the circuit board assembly 36 is coupled to an on/off & heat control actuator 38, which may be in the form of a button(s), keypad, or dial. Further, the circuit board assembly 36 is secured to the base assembly 14 with wiring between the rechargeable batteries 16, charging inlet port 40 (i.e., recharger), heating elements 56, and air blower assembly 58 in a conventional manner. In this way, a complete circuit is generated amongst the power management module 35, the on/off & heat control actuator 38, the circuit board assembly 36, and the rechargeable batteries 16.

It is appreciated that some heater units 12 may require AC current and the power assembly 34 is provided with an inverter 39 in accordance with the disclosed embodiment. In situations where the heater units 12 require DC current, an inverter 39 would not be necessary and may be bypassed or not included with the power assembly 34.

Enhanced functionality of the present portable electric heater 10 is achieved by the provision of the charging inlet port 40, a USB outlet port 42, and an information/control panel 44 in the power management module 35. While a charging inlet port 40 is disclosed above in accordance with a disclosed embodiment, it is appreciated the portable electric heater could be provided with a cord with a plug that is stored in the base assembly and adapted to plug into a household electrical (120*v*) outlet for recharging the rechargeable batteries 16. In accordance with a disclosed embodiment, the information/control panel 44 is formed in the side wall 22 of the base assembly 14. The charging inlet port 40 (or the cord with a plug), the USB outlet port 42, and the information/control panel 44 are electrically connected to the rechargeable batteries 16 using known circuitry. Control of the charging inlet port 40, the USB outlet port 42, and the information/control panel 44 is achieved using known circuitry that is incorporated into the power management module 35. As those skilled in the art will appreciate, the information/control panel 44 shows charging/power status while the device is charging so the operator is always aware of the power level (remaining battery level).

The electric heater unit 12 includes a horizontally oriented heater assembly 50 telescopically supported by the support shaft 18. The heater assembly 50 includes an elongated heater housing 54 with a long horizontal width component and a short vertical height component, a heating element (or elements) 56, and an air blower assembly 58 for providing an adjustable heated air stream at a height above the base assembly 14. In accordance with a disclosed embodiment, the heating elements are standard resistive heating elements, halogen heating elements, ceramic heating elements, or other known heating structures. It is further contemplated that the heating elements may be infrared heating elements (for example, quartz based infrared heating elements), which heat the surfaces of those objects the transmitted infrared rays contact, and would obviate the need for the air blower assembly as the infrared heating elements would act directly upon those sitting in the vicinity of the electric heater unit 12. The support shaft 18 is secured between the base assembly 14 and the heater assembly 50. While is single heater assembly is disclosed herein, it is appreciated multiple heater assemblies could be integrated into a single apparatus.

The heater housing 54 has one or more sidewalls defining an interior space. The heater housing 54 has an elongated construction, although it is appreciated other configurations are possible within the spirit of the invention. The heater housing 54 also includes one or more air inlet openings 62 and an air outlet opening 64. Protective grills 66 are disposed over the one or more air inlet openings 62 and the air outlet opening 64. An air blower assembly 58 and the heating element 56 are positioned within the interior space defined the heater housing.

In accordance with a disclosed embodiment, and as briefly mentioned above, the length of the support shaft 18 is adjustable via a telescopic mechanism, for example, a series of collapsible sleeves controlled by a drive assembly, allowing one to adjust the height of the heater assembly 50 to provide more direct heat to users sitting near the heater assembly. In accordance with a disclosed embodiment, the telescopic construction operates manually, although it is appreciated motors and other mechanisms allowing for an automated telescoping construction could be employed without departing from the invention.

The air blower assembly 58 includes one or more motors 82, and an air impeller 84 connected to the motor(s) 82. All of the air being discharged from air blower assembly 58 flows through the heating element 56. It is contemplated that the heating element 56 may be turned off as desired to allow for unheated air to be discharged from air blower assembly 58 (for cooling instead of heating).

The air impeller 84 causes air to be drawn into the heater housing 54 through the one or more air inlet openings 62. The air flow passes through air blower assembly 58, passes through heating element 56, and exits the heater housing 54 through the air outlet opening 64. As the air flow passes through heating element 56, thermal energy (i.e., heat) is imparted to the air flow. While an air blow assembly is contemplated in a disclosed embodiment, an embodiment not including an air blow assembly is contemplated where radiant heat is desired.

In some embodiments the heater housing rotates with respect to the support shaft. The rotation may be accomplished either in an oscillatory fashion (over any angular range that may be desired), a stepwise positioning of housing (either manually or under automated control), or in a constant rotation, either in a clockwise or counterclockwise direction (or back and forth). The mechanism for rotation may be located within or below the heater housing and coupled between the housing and the support shaft. In yet another embodiment, the rotation mechanism may be located between base assembly and the support shaft.

FIGS. 1 and 2 shows a representative oscillation mechanism 88. The oscillation mechanism 88 moves the heater housing 54 of portable pedestal electric heater unit 12 through rotation and/or oscillation movement. The movement allows the heated exhaust air stream to be dispersed over a larger coverage area. In accordance with a disclosed embodiment, the oscillation mechanism 88 includes a motor, gear, oscillation plate, and oscillation section. It is contemplated that other rotating mechanisms, such as a link and pivot design, may be used to achieve rotation/oscillation movement.

Figure 3:
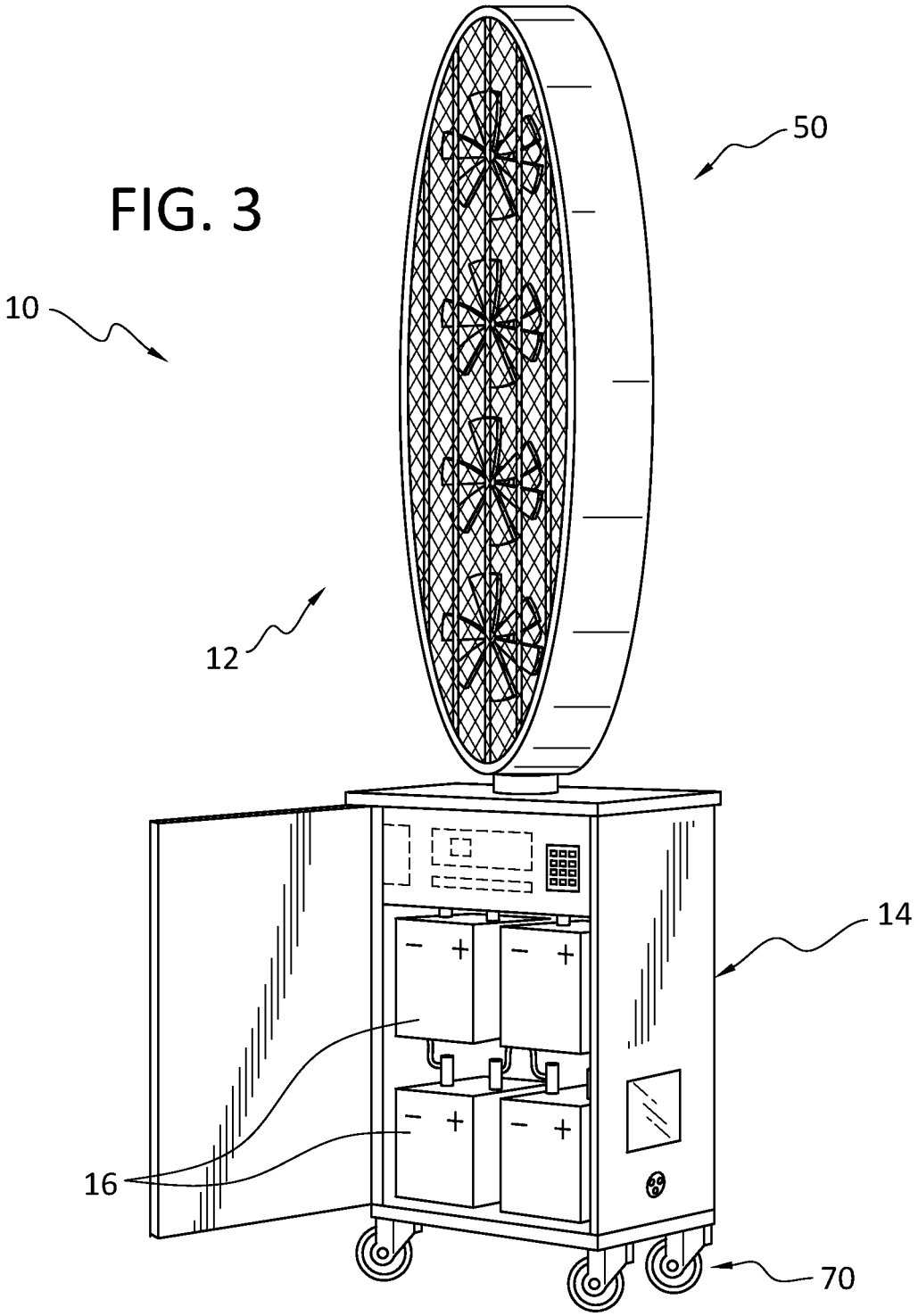
FIGS. 3 and 4 are front views of alternate embodiments.
Figure 4:
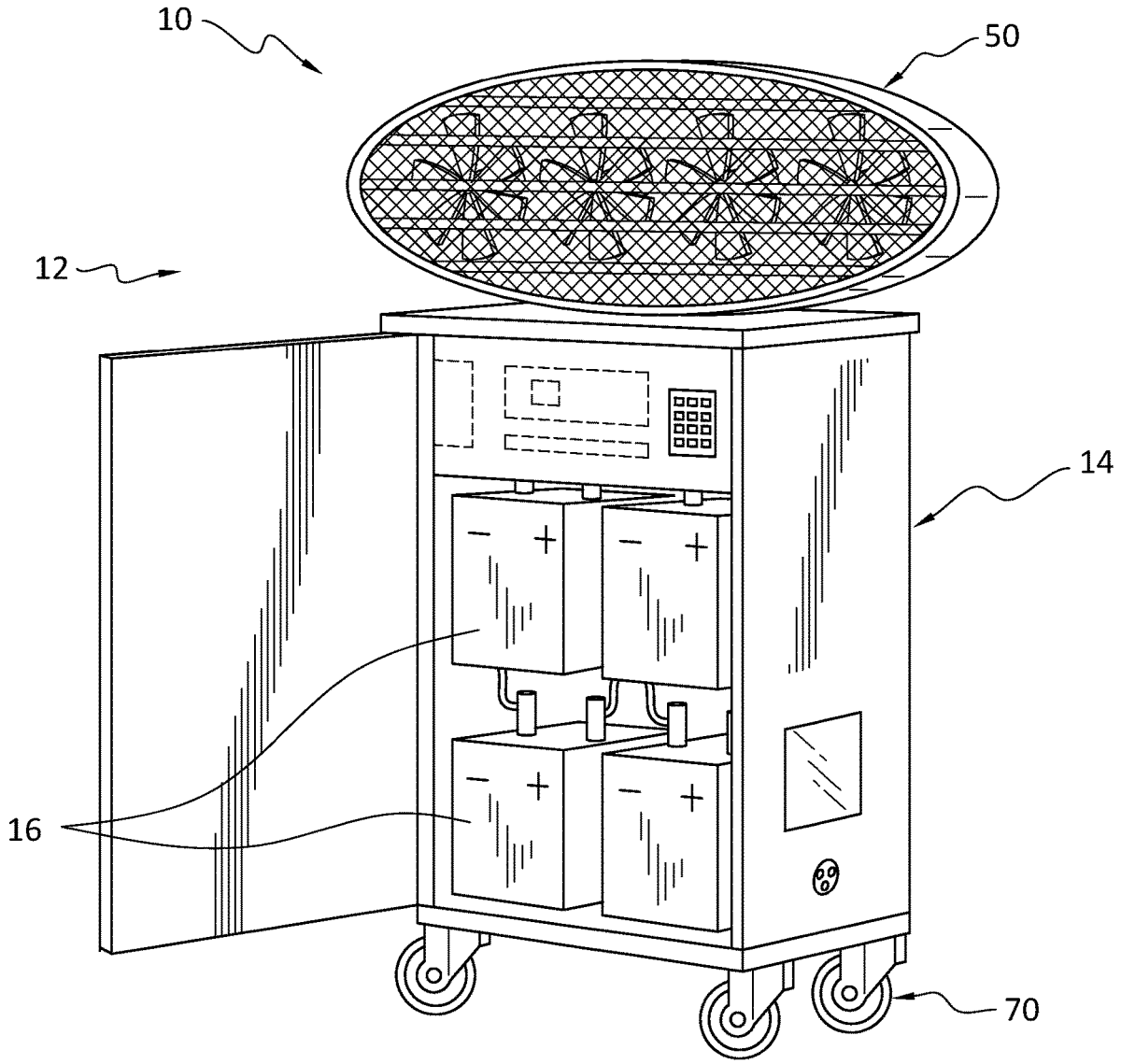

While a specific heater unit structure is presented above in accordance with a disclosed embodiment, the heater unit could take a variety of forms and shapes as disclosed with reference to the embodiments shown in FIGS. 3 and 4.

Further still, the heater unit may be constructed using different air moving and heating techniques. For example, and with reference to the embodiment shown in FIGS. 1 and 2, a heater unit 112 as disclosed in PCT Publication No. WO2023187325, entitled "A FAN ASSEMBLY"; PCT Publication No. WO2023166299, entitled "FAN ASSEMBLY"; PCT Publication No. WO2022180389, entitled "AIR AMPLIFIER"; U.S. Pat. No. 10,174,764B2, entitled "Fan with nozzle retainer"; U.S. Pat. No. 10,145,583, entitled "Heating apparatus"; U.S. Pat. No. 9,822,778, entitled "Fan assembly"; U.S. Pat. No. 8,873,940, entitled "Fan assembly"; U.S. Pat. No. 8,366,403, entitled "Fan assembly"; U.S. Pat. No. 8,734,094, entitled "Fan assembly"; and U.S. Pat. No. 8,197,226, entitled "Fan assembly", all of which are incorporated by reference.

While the fan assemblies presented above utilize a system that brings air in (air intake) from its base, then moves the air up through a curved head that has hidden ceramic heating elements (which heat very quickly which nicely reduce warmup times), FIGS. 8A to 8B, which are discussed below in greater detail, provide an air intake 470 at the base of the support shaft 418 such that the air moves through the inside of the support shaft 418 with the heating elements up to the head for heating and distribution. FIGS. 9A to 9B, which are discussed below in greater detail, provide an air intake 570 in the base assembly such that the air moves through the inside of the support shaft 518 with the heating elements up to the head for heating and distribution. This produces a heater unit that is powerful, yet quiet. In conjunction with such an embodiment, the air distribution can be focused narrow or wide and the heater unit can be set to rotate automatically or be manually tilted.

The base assembly 14 of the portable electric heater 10 includes an integrated caster assembly 70 along the bottom thereof. More particularly, the caster assembly 70 is integrated into the base platform 20, and functions as the bottom of the base assembly 14 in which the rechargeable batteries 16 are stored.

The base platform 20 includes an upper surface 74, a lower surface 76, and a sidewall 77 extending between the upper surface 74 and the lower surface 76. The base platform 20 also includes a plurality of downwardly extending lockable caster wheels 78 secured to the lower surface 76 thereof. In accordance with a disclosed embodiment, four (4) caster wheels 78 are secured to the base platform 20 at equidistant positions about the circumference of the base platform 20. Four bolts are used to secure each caster wheel 78 to the base platform 20. The positioning of the lockable swivel caster wheels 78 at the perimeter of the base platform 72 also provides for ease of rolling. The lockable swivel caster wheels 78 are off-the-shelf items and various types of caster wheels may be used without departing from the spirit of the present invention.

In an effort to provide additional support for the base platform 72 in the area under the center of the base platform 72, at least one nonlocking swivel caster wheel may be utilized and is secured to the lower surface 76 of the base platform 72. The nonlocking swivel caster wheel extends between the lower surface 76 of the base platform 72 and the surface upon which the portable electric heater 10 is positioned to provide additional support in the center of the base platform 72. While a single nonlocking swivel caster wheel is disclosed herein, it is appreciated that no central casters may be utilized, or a plurality of nonlocking swivel caster wheels could be employed without departing from the spirit of the present invention.

The portable electric heater 10 provides anti-tip technology by enhancing leverage to lower the incidence of dangerous tipping of the portable electric heater 10 during movement. By positioning the caster wheels 78 to the limits of the base assembly 14 and positioning of the batteries 16 as low as possible, the center of gravity is lowered and increased leverage is provided against tipping.

In addition, and despite the fact the portable electric heater is disclosed above for use to heat limited areas, the portable electric heater does include fan structures that may be utilized with the heating elements turned off. As such, the portable electric heater could be used to move air and cool users positioned adjacent to the portable electric heater.

In accordance with other embodiments as shown with reference to FIGS. 5A, 5B, 6, and 7, the portable electric heater 110, 210, 310 incudes a shaft in the form of either a telescoping pole 118 (see FIGS. 5A and 5B), a gooseneck pole 218 (see FIG. 6), or an articulating pole 318 (see FIG.

7) to be able to cantilever the heater unit 112, 212, 312 over a table or leaning toward the center of the table to heat downward to heat the diners equally. While arched poles 118, 218 are disclosed in conjunction with the embodiments shown in FIGS. 5A and 5B and FIG. 6, it is appreciated the cantilever created by the pole need not be achieved by an arched pole, but may be achieved by constructing the poles 318 in straight articulating segments as shown in FIG. 7. Given the cantilevered nature of the poles, it is further appreciated these embodiments may including integrated lighting elements 119, 219, 319 that will focus down upon the table and people using the portable electric heater.

In accordance with each of these embodiments, the pole 118, 218, 318 houses the wiring to run up to the heater unit 112, 212, 312 and has a diameter to accommodate any necessary components for communicating between the base assembly 114, 214, 314 and the heater unit 112, 212, 312. When considering this construction, it should be appreciated that the heater unit 112, 212, 312 is lightweight and the base assembly 114, 214, 314 holding the batteries 116, 216, 316 is significantly heavier. The heavy base assembly 114, 214, 314 prevents the heater unit 112, 212, 312 from tipping over.

Figure 5A:
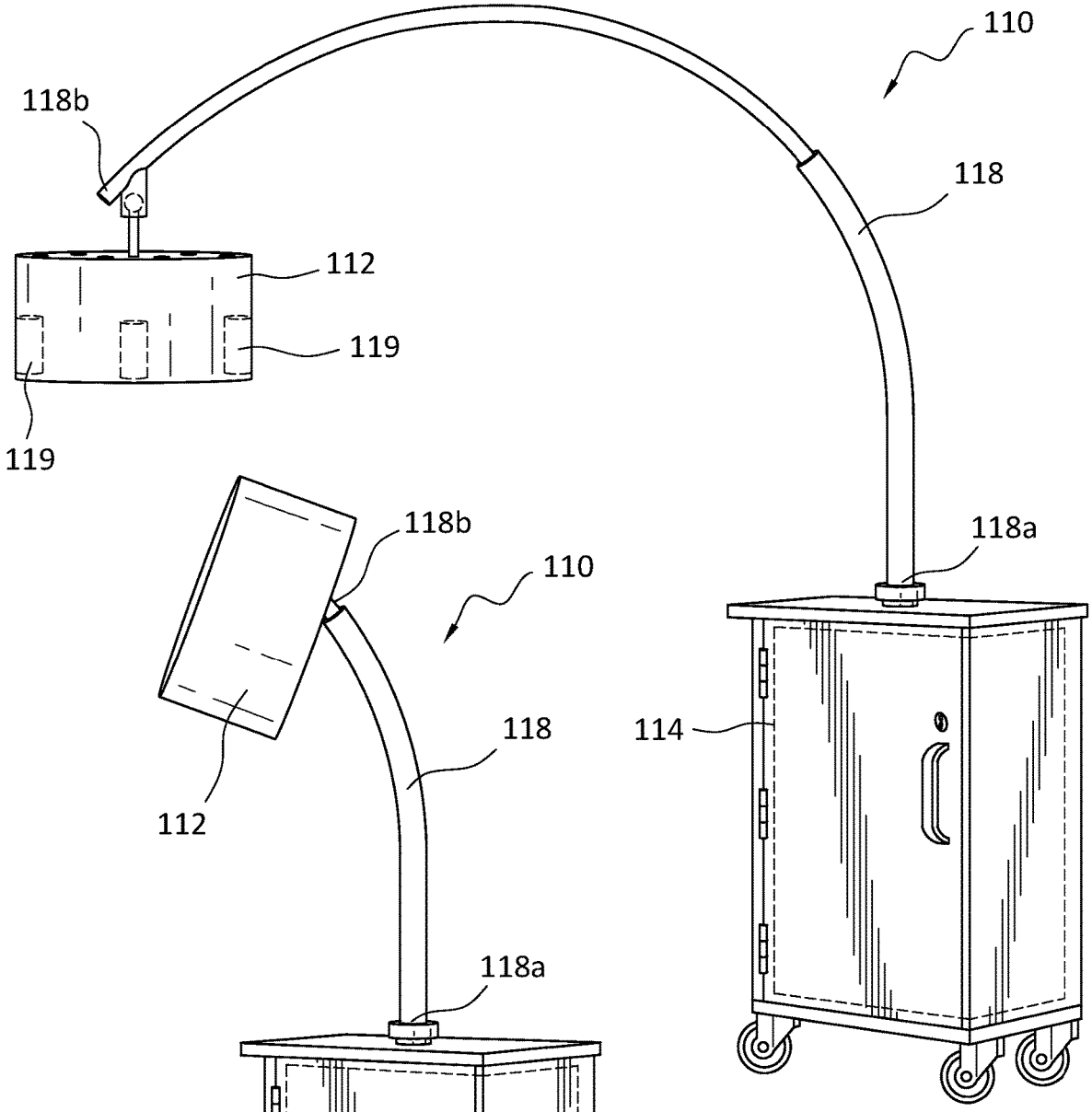
FIGS. 5A and 5B disclose an alternate embodiment in an extended orientation and a retracted orientation, respectively.
Figure 5B:
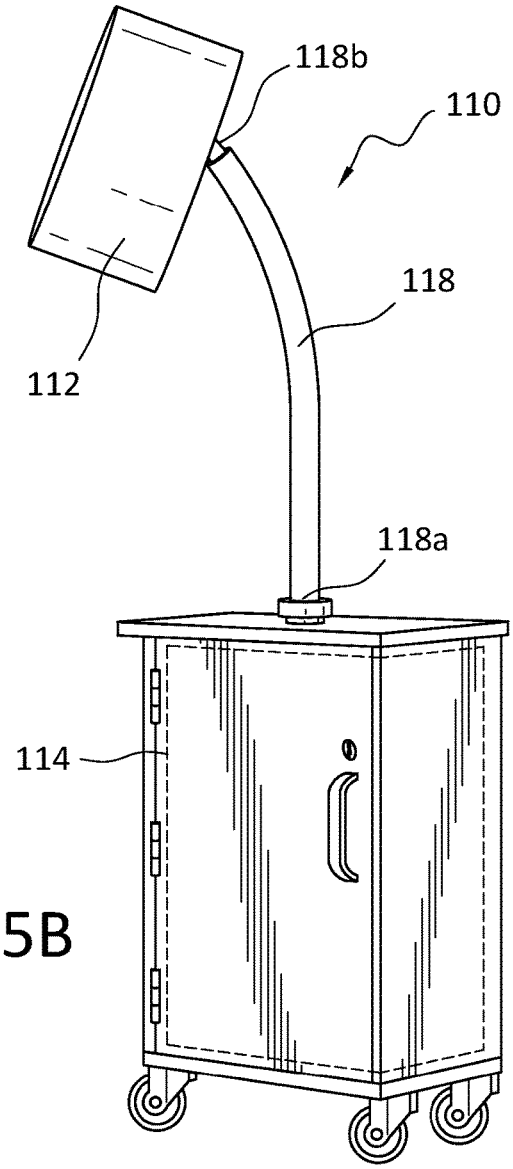

Referring now to the embodiments shown in FIGS. 5A and 5B, the portable electric heater 110 includes a heater unit 112 and base assembly 114. A renewable energy source 116 is stored within the base assembly 114 for powering the heater unit 112. In accordance with a disclosed embodiment, the renewable energy source 116 is a rechargeable battery (ies), in particular, a rechargeable lithium-ion battery, although, and as discussed above, the renewable energy source of the present invention may take various forms.

The portable electric heater 110 also includes a shaft 118 that extends upwardly from the base assembly 114. In accordance with the disclosed embodiment, the support shaft is a telescoping pole 118. The telescoping pole 118 includes a first end 118*a* secured to the base assembly 114 and a second end 118*b* to which the heater unit 112 is secured. In accordance with a disclosed embodiment, the telescoping pole 118 is formed from two concentric pole in a traditional manner.

The base assembly 114 is as described above with reference to FIGS. 1 and 2. The electric heater unit 112 is as described with reference to FIGS. 1 and 2 or with reference to the embodiment disclosed below with reference to FIGS. 7A and 7B.

Figure 6:
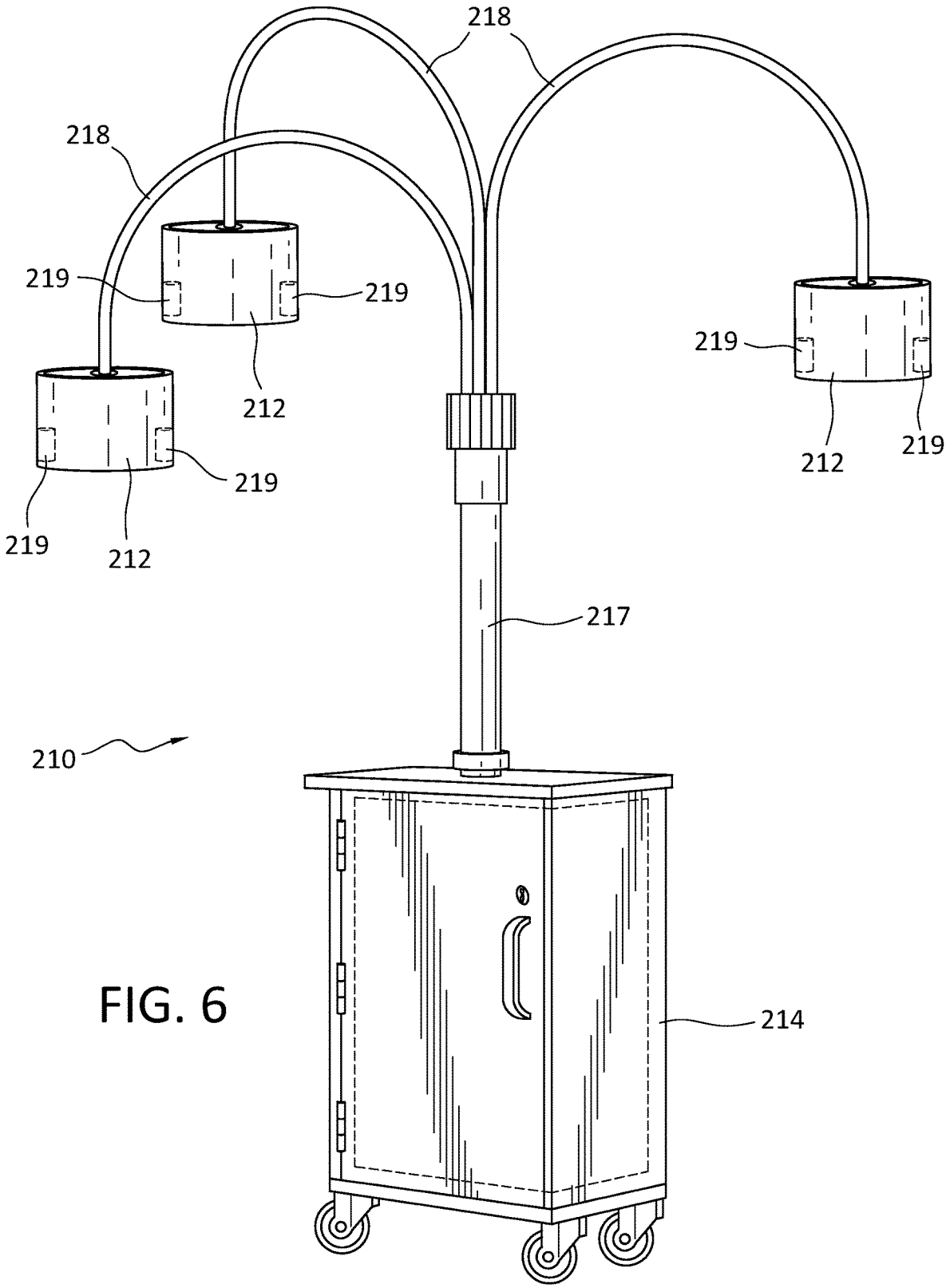
FIG. 6 is a perspective view showing another embodiment in accordance with the present invention.
Figure 7:
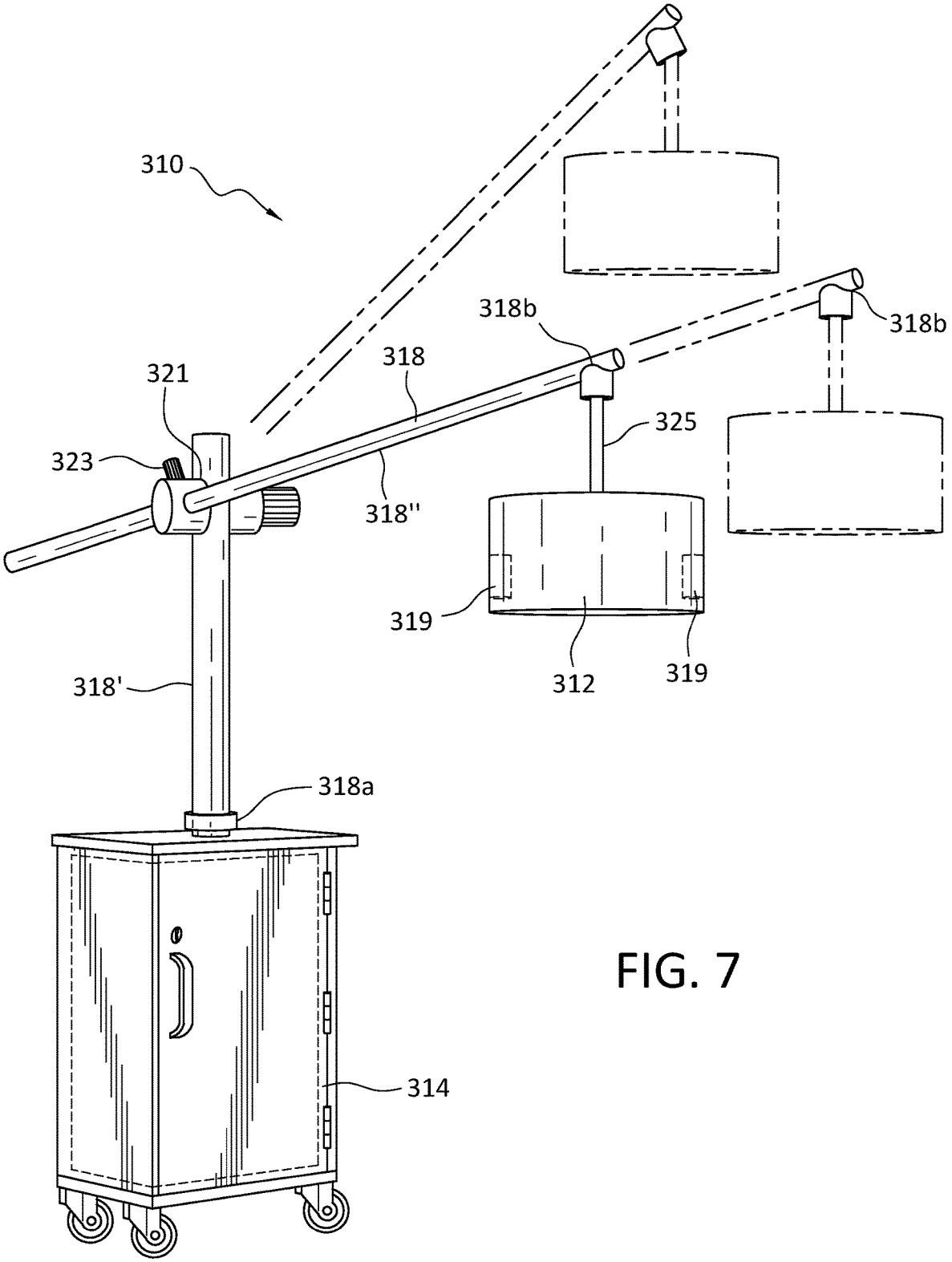
FIG. 7 is a perspective view showing another embodiment in accordance with the present invention.

Referring now to the embodiment shown in FIGS. 6, the portable electric heater 210 includes a plurality of heater units 212 and a base assembly 214. A renewable energy source 216 is stored within the base assembly 214 for powering the heater units 212. In accordance with a disclosed embodiment, the renewable energy source 216 is a rechargeable battery (ies), in particular, a rechargeable lithium-ion battery, although, and as discussed above, the renewable energy source of the present invention may take various forms.

The portable electric heater 210 also includes a plurality of support shafts 218, extending from a primary support shaft 217 that extends upwardly from the base assembly 214 for attachment to each of the heater units 212. In accordance with the disclosed embodiment, the support shaft is of a gooseneck construction; that is, tubing made with a combination of round spring steel and triangle rods wherein when the tubing is bent to a desired shape the tubing will hold the desired shape.

The base assembly 214 is as described above with reference to FIGS. 1 and 2. The electric heater unit 212 is as described with reference to FIGS. 1 and 2 or with reference to the embodiment disclosed below with reference to FIGS. 7A and 7B.

Referring now to the embodiment shown in FIG. 6, the portable electric heater 310 includes a heater unit 312 and a base assembly 314. A renewable energy source 316 is stored within the base assembly 314 for powering the heater units 312. In accordance with a disclosed embodiment, the renewable energy source 316 is a rechargeable battery (ies), in particular, a rechargeable lithium-ion battery, although, and as discussed above, the renewable energy source of the present invention may take various forms.

The portable electric heater 310 also includes a support shaft 318 that extends upwardly from the base assembly 314 for attachment to the heater unit 312. In accordance with the disclosed embodiment, the support shaft 318 is an articulating pole assembly, for example, including first and second pivotally connected poles 318', 318". The articulating pole 218 includes a first end 218*a* secured to the base assembly 214 and a second end 218*b* with a mounting elements 325 to which the heater unit 212 is secured. The pivotal connection 321 securing the pivotally connected poles 318', 318" also includes set screw 323 allowing for release of the second pivotally connected pole 318" to extend or retract the second pivotally connected pole 318".

The base assembly 214 is as described above with reference to FIGS. 1 and 2. The electric heater unit 212 is as described with reference to FIGS. 1 and 2 or with reference to the embodiment disclosed below with reference to FIGS. 7A and 7B.

In accordance with any of the embodiments disclosed above, and as briefly discussed above, it is appreciated LED lights 119, 219, 319 can be added, for example, to the heater unit, to provide dimmable lighting for the table occupants, and overcome any lighting issues created by positioning the heater unit, and the remainder of the electric heater over and/or adjacent to the table occupants.

Figures 8A, 8B:
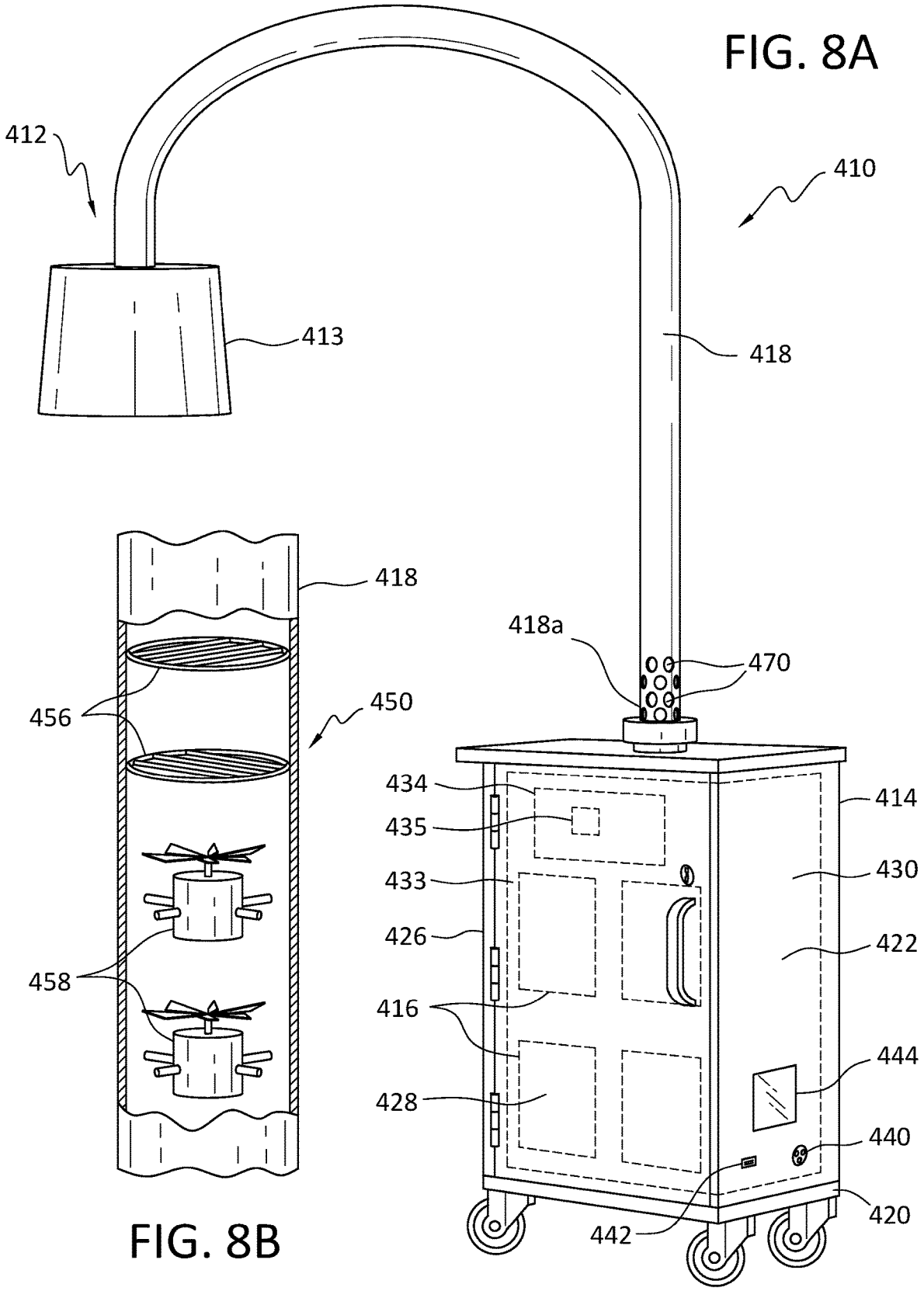
FIGS. 8A and 8B disclose yet another embodiment showing a perspective view and a detailed internal view of the shaft, respectively.
Figures 9A, 9B:
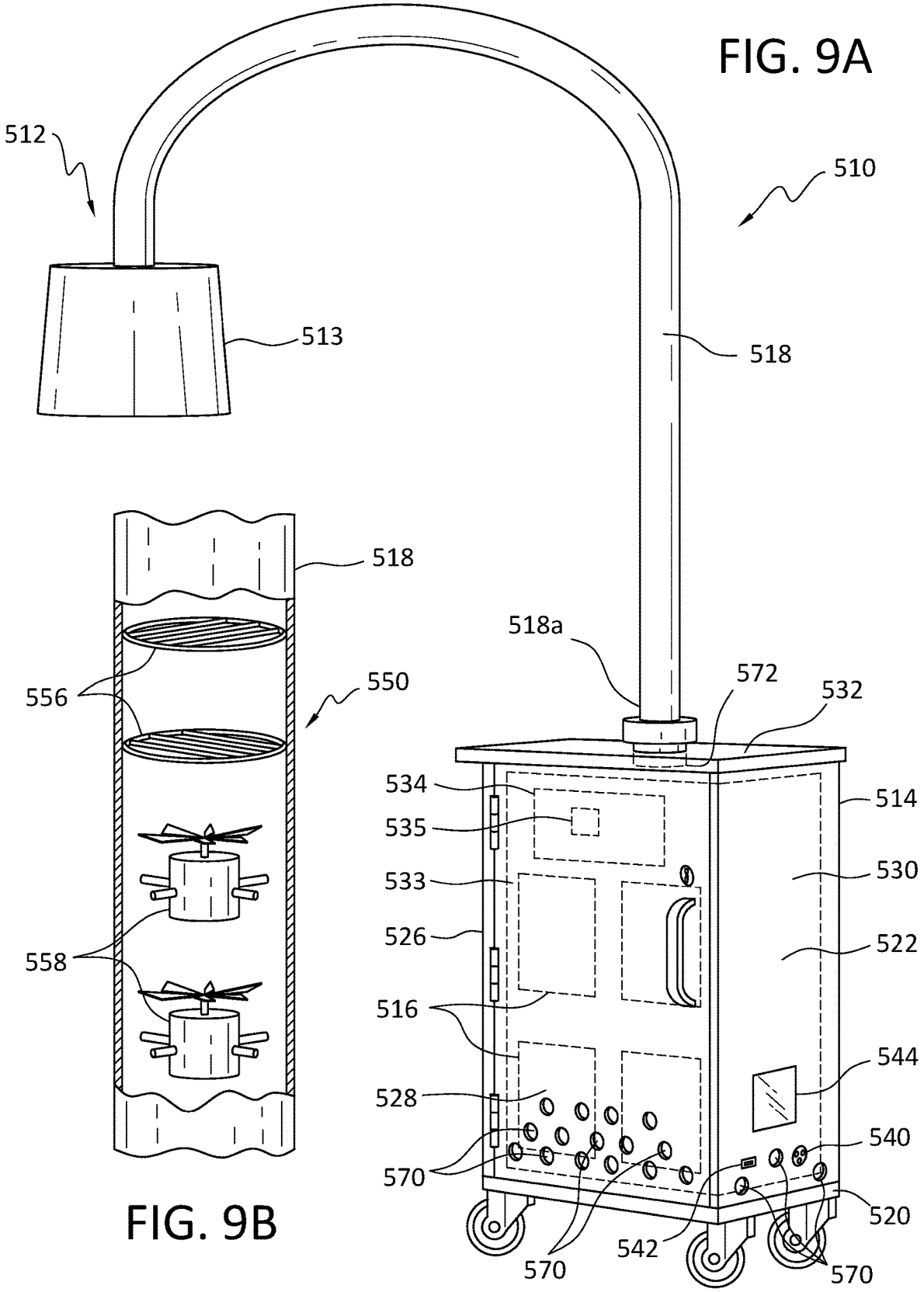
FIGS. 9A and 9B disclose yet another embodiment showing a perspective view and a detailed internal view of the shaft, respectively.

In accordance with yet another embodiment, and with reference to FIGS. 8A and 8B, a portable electric heater 410 is disclosed. As will be appreciated, this embodiment utilizes an air intake 470 at the base, that is, the first end 418*a*, of the support shaft 418 such that the air moves through the inside of the support shaft 418 with the heating element(s) 456 up to the head for heating and distribution. This results in a portable electric heater 410 that is powerful, yet quiet.

As with the prior embodiments, the portable electric heater 410 includes a heater unit 412 and base assembly 414. A renewable energy source 416 is stored within the base assembly 414 for powering the heater unit 412. In accordance with a disclosed embodiment, the renewable energy source 416 is a rechargeable battery (ies), in particular, a rechargeable lithium-ion battery. While lithium-ion batteries are disclosed in accordance with a disclosed embodiment, the renewable energy source of the present invention may take various forms as discussed above with regard to the embodiment disclosed with reference to FIGS. 1 and 2.

The portable electric heater 410 also includes a support shaft 418 that extends upwardly from the base assembly 414. The support shaft 418 includes a first end 418*a* secured to the base assembly 414 and a second end 418*b* to which the heater unit outlet 413 is secured. In accordance with a disclosed embodiment, the support shaft 418 is arcuate and cantilevered. The support shaft may also be telescopic (as disclosed above with reference to FIGS. 4A and 4B) and allow operators to adjust the height of the portable electric heater. The support shaft 418 is secured between the base assembly 414 and the heater unit outlet 413. As will be appreciated based upon the following, the support shaft 418 may also be thought of as composing part of the heater assembly 450.

While a shaft structure is disclosed herein in accordance with a disclosed embodiment, it is appreciated that the shaft structure may take various forms as disclosed in conjunction with the various embodiments presented herein.

The base assembly 414 is as described above with reference to FIGS. 1 and 2. As such, it includes a base platform 420 with a plurality of side walls 422 and 428 (the second and third side walls are not shown in FIGS. 8A and 8B, but are the same as disclosed in FIGS. 1 and 2. The base assembly 414, in particular, the enclosure 433, defines a cavity 430 within which at least one rechargeable battery 416 (four are shown in a disclosed embodiment). In order to provide the functionality offered by the present portable electric heater 410, the disclosed embodiment uses a battery set-up as discussed above with regard to FIGS. 1 and 2.

The base assembly 414 also includes an electrical power assembly 434. The power assembly 434 is secured within the cavity 430 of the enclosure 433 of the portable electric heater 410. The power assembly 434 is as disclosed above with reference to FIGS. 1 and 2.

It is appreciated that some heater units 412 may require AC current and the power assembly 434 is provided with an inverter (see FIG. 1) in accordance with the disclosed embodiment. In situations where the heater units 412 require DC current, an inverter would not be necessary and may be bypassed or not included with the power assembly 434.

Enhanced functionality of the present portable electric heater 410 is achieved by the provision of the charging inlet port 440, a USB outlet port 442, and an information/control panel 444 in the power management module 435. While a charging inlet port 340 is disclosed above in accordance with a disclosed embodiment, it is appreciated the portable electric heater could be provided with a cord with a plug as discussed above with reference to the embodiment of FIGS. 1 to 2. In accordance with a disclosed embodiment, the information/control panel 444 is formed in the side wall 422 of the base assembly 414. The charging inlet port 440 (or the cord with a plug), the USB outlet port 442, and the information/control panel 444 are electrically connected to the rechargeable batteries 316 using known circuitry. Control of the charging inlet port 440, the USB outlet port 442, and the information/control panel 444 is achieved using known circuitry that is incorporated into the power management module 435. As those skilled in the art will appreciate, the information/control panel 444 shows charging/power status while the device is charging so the operator is always aware of the power level (remaining battery level).

The electric heater unit 412 includes a heater assembly 450 composed of the support shaft 418, air blower assemblies (for example, fans) 458 within the support shaft 418, and heating element(s) (for example, standard resistive heating elements, halogen heating elements, or other known heating structures) 456 within the support shaft 418. In contrast to the prior embodiments, the heating element (or elements) 456 and the air blower assembly 458 are housed within the support shaft 418 and the support shaft 418 is, therefore, considered to be part of heater assembly 450 when considering the present embodiment. In accordance with a disclosed embodiment, the heating elements are standard resistive heating elements, halogen heating elements, ceramic heating elements, or other known heating structures.

As the heating element (or elements) 456 and the air blower assembly (assemblies) 458 are housed within the support shaft 418, the support shaft 418 includes at least one aperture 470 adjacent the first end 418*a* of the support shaft 418 thereof and the air blower assembly 458 thereby draws air into the support shaft 418 creating a flow of air from the at least one aperture 470 adjacent the first end 418*a* of the support shaft 418 to the heater unit outlet 413 at the second end 418*b* of the support shaft 418 where it is directed in a desired direction to warm users. As the retention of the heat created within the support shaft 418 is important, the support shaft 418 is insulated using various insulating materials known in the art.

In accordance with yet another embodiment, and with reference to FIGS. 9A and 9B, the air may be drawn through the base assembly resulting in the cooling of the battery (ies) and other electronic components, as well as the preheating of the air is it moves through the base assembly and into the support shaft. As will be appreciated, this embodiment utilizes an air intake 570 at the walls at the base of the base assembly 514 such that the air moves through the inside of the base assembly 514, into the support shaft 518, with the heating element(s) 556, and ultimately up to the head for heating and distribution. This results in a portable electric heater 510 that is powerful, yet quiet.

As with the prior embodiments, the portable electric heater 510 includes a heater unit 512 and base assembly 514. A renewable energy source 516 is stored within the base assembly 514 for powering the heater unit 512. In accordance with a disclosed embodiment, the renewable energy source 516 is a rechargeable battery (ies), in particular, a rechargeable lithium-ion battery, although and as discussed above with respect to FIGS. 1 and 2, the renewable energy source of the present invention may take various forms.

The portable electric heater 510 also includes a support shaft 518 that extends upwardly from the base assembly 514. The support shaft 518 includes a first end 518*a* secured to the base assembly 514 and a second end 518*b* to which the heater unit outlet 513 is secured. The base assembly 414 includes an aperture 572 at the location of the connection of first end 518*a* of the support shaft 518 to the top member 532 the base assembly 514 that is provided with a such that air flow freely from the interior of the base assembly 514 and into the support shaft 518.

As with the embodiment shown in FIGS. 8A and 8B, the support shaft 518 is arcuate and cantilevered. The support shaft may also be telescopic (as disclosed above with reference to FIGS. 4A and 4B) and allow operators to adjust the height of the portable electric heater. The support shaft 518 is secured between the base assembly 514 and the heater unit outlet 513. As will be appreciated based upon the following, the support shaft 518 may also be thought of as composing part of the heater assembly 550. While a shaft structure is disclosed herein in accordance with a disclosed embodiment, it is appreciated that the shaft structure may take various forms as disclosed in conjunction with the various embodiments presented herein.

The base assembly 514 is as described above with reference to FIGS. 1 and 2. As such, it includes a base platform 520 with a plurality of side walls 522 and 528 (the second and third side walls are not shown in FIGS. 9A and 9B, but are the same as disclosed in FIGS. 1 and 2). The base assembly 514, in particular, the enclosure 533, defines a cavity 530 within which at least one rechargeable battery 516 (four are shown in a disclosed embodiment), as discussed above with respect to the prior embodiments, is positioned.

As discussed above, the base assembly includes a plurality of apertures 570 formed in the plurality of side walls 522 and 528 (the second and third side walls are not shown in FIGS. 9A and 9B, but are the same as disclosed in FIGS. 1 and 2). These apertures allow for air to be drawn through the base assembly 514 resulting in the cooling of the battery (ies) and other electronic components, as well as the preheating of the air as it moves through the base assembly 514 and into the support shaft. As a results, air moves through the inside of the base assembly 514, into the support shaft 518 (via and aperture 572 at the location of the connection of first end 518*a* of the support shaft 518 to the top member 532 the base assembly 514), with the heating element(s) 556, and ultimately up to the head for heating and distribution.

The base assembly 514 also includes an electrical power assembly 534. The power assembly 534 is secured within the cavity 530 of the enclosure 533 of the portable electric heater 510. The power assembly 534 is as disclosed above with reference to FIGS. 1 and 2. As with the prior embodiments, the power assembly 534 may be provided with an inverter (see FIG. 1) where the heater units 512 require AC power.

As with the prior embodiments, the portable electric heater 510 includes a charging inlet port 540, a USB outlet port 542, and an information/control panel 544 in the power management module 535. Also, it is appreciated the portable electric heater could be provided with a cord with a plug as discussed above with reference to the embodiment of FIGS. 1 to 2. The information/control panel 544 is formed in the side wall 522 of the base assembly 514. The charging inlet port 540 (or the cord with a plug), the USB outlet port 542, and the information/control panel 544 are electrically connected to the rechargeable batteries 516 using known circuitry. Control of the charging inlet port 540, the USB outlet port 542, and the information/control panel 544 is achieved using known circuitry that is incorporated into the power management module 535. The information/control panel 544 shows charging/power status while the device is charging so the operator is always aware of the power level (remaining battery level).

The electric heater unit 512 includes a heater assembly 550 composed of the support shaft 518, air blower assemblies (for example, fans) 558 within the support shaft 518, and heating element(s) (for example, standard resistive heating elements, halogen heating elements, or other known heating structures as discussed above with respect to the prior embodiments) 556 within the support shaft 518. As with the embodiment disclosed with reference to FIGS. 8A and 8B, the heating element (or elements) 556 and the air blower assembly 558 are housed within the support shaft 518 and the support shaft 518 is, therefore, considered to be part of heater assembly 550 when considering the present embodiment. In accordance with a disclosed embodiment, the heating elements are standard resistive heating elements, halogen heating elements, ceramic heating elements, or other known heating structures.

As the heating element (or elements) 556 and the air blower assembly (assemblies) 558 are housed within the support shaft 518, the support shaft 518 includes at least one aperture 570 adjacent the first end 518*a* of the support shaft 518 thereof and the air blower assembly 558 thereby draws air into the support shaft 518 creating a flow of air from the at least one aperture 570 adjacent the first end 518*a* of the support shaft 518 to the heater unit outlet 513 at the second end 518*b* of the support shaft 518 where it is directed in a desired direction to warm users. As the retention of the heat created within the support shaft 518 is important, the support shaft 518 is insulated using various insulating materials known in the art.

While the preferred embodiments have been shown and described, it will be understood that there is no intent to limit the invention by such disclosure, rather, is intended to cover all modifications and alternate constructions falling within the spirit and scope of the invention.

The invention claimed is:

1. A portable electric heater, comprising:

a heater unit;

a base assembly comprising a base platform with a plurality of side walls extending upwardly therefrom, each of the plurality of side walls includes an upper edge, wherein the upper edges of the plurality of side walls define an open upper end of the base assembly that is provided with a top member, the base platform, plurality of side walls, and the top member define an enclosure of the base assembly, the base assembly further including a plurality including a plurality of apertures that function as air intake;

a shaft extends upwardly from the top member of the base assembly, the shaft includes a first end secured to the base assembly and a second end to which the heater unit is secured, the heater unit including air blower assembly and heating elements positioned within the shaft such that the air blower assembly draws air into the shaft creating a flow of heated air through the shaft and out the second end of the shaft ort shaft where it is directed in a desired direction to warm users, the base assembly includes an aperture in the top member the base assembly and the first end of the shaft is connected to the base assembly in alignment with the aperture such that air flows freely through the plurality of apertures of the base assembly, through the interior of the base assembly, and into the support shaft; and a renewable energy source stored the enclosure of the base assembly, the renewable energy source is at least one rechargeable battery, wherein air flowing through the base assembly interacts with the at least one rechargeable battery; and a power assembly including a power management module for controlling distribution of electrical power from the renewable energy source to the heater unit.

2. The portable electric heater according to claim 1, wherein the at least one rechargeable battery is a rechargeable lithium-ion battery.

3. The portable electric heater according to claim 1, wherein the plurality of side walls includes a first side wall, a second side wall, and a third side wall, respectively extending upwardly from edges of the base platform, a fourth side wall is connected, via a hinge, to the third side wall allowing for access to a cavity.

4. The portable electric heater according to claim 1, wherein the power management module includes a circuit board assembly.

5. The portable electric heater according to claim 4, wherein the power management module also includes an on/off & heat control actuator, a charging inlet port, a USB outlet port, and an information/control panel.

6. The portable electric heater according to claim 5, wherein the power assembly also includes an inverter.

7. The portable electric heater according to claim 1, wherein the plurality of apertures are formed in the side walls of the base.

8. The portable electric heater according to claim 7, further including a heater unit outlet secured to the second end of the shaft.

9. The portable electric heater according to claim 1, wherein positioning of the renewable energy source within the base assembly allows for lowering the center of gravity and protecting against tipping.

10. The portable electric heater according to claim 1, wherein the shaft is telescopically extendable.

11. The portable electric heater according to claim 1, wherein the shaft is cantilevered.

12. The portable electric heater according to claim 1, further including lighting elements integrated into the portable electric heater.

* * * * *